US005533563A

United States Patent [19]

Lee, Sr.

[11] Patent Number: 5,533,563

[45] Date of Patent: Jul. 9, 1996

[54] MOLD AND METHOD FOR MAKING VARIABLE HARDNESS CASTINGS

[76] Inventor: Lawrence J. Lee, Sr., 17497 N. Fruitport Rd., Spring Lake, Mich. 49456

[21] Appl. No.: 413,513

[22] Filed: Mar. 30, 1995

[51] Int. Cl.[6] ..... B22D 15/00

[52] U.S. Cl. ..... 164/127; 164/353; 164/355

[58] Field of Search ..... 164/137, 339, 164/127, 352, 353, 354, 355, 356, 357

[56] References Cited

U.S. PATENT DOCUMENTS

| | | | |
|---|---|---|---|
| 638,774 | 12/1899 | Thackray . | |
| 843,679 | 2/1907 | Johns . | |
| 1,833,128 | 11/1928 | Robe | 164/355 |
| 2,110,455 | 3/1938 | Steele et al. | 164/127 |
| 5,072,773 | 12/1991 | Ruff et al. . | |
| 5,122,204 | 6/1992 | McDonald | 164/127 |

FOREIGN PATENT DOCUMENTS

| | | |
|---|---|---|
| 58-112651 | 7/1983 | Japan . |
| 59-10445 | 1/1984 | Japan . |
| 4-220151 | 8/1992 | Japan . |
| 694277 | 7/1953 | United Kingdom . |
| 2175521 | 12/1986 | United Kingdom . |

*Primary Examiner*—Jack W. Lavinder
*Assistant Examiner*—Randolph S. Herrick
*Attorney, Agent, or Firm*—Varnum, Riddering, Schmidt & Howlett

[57] ABSTRACT

A mold and method for making castings having variable hardness is disclosed. The mold assembly includes a cope and drag captured between a pair of carrier plates. Chill members depend from the carrier plates and are received in appropriate apertures formed in the cope and drag. The chill members are inserted into the cope and drag after formation thereof and are removed therefrom prior to shake-out of the molded article. The chill members are used to control the cooling of the molded article.

20 Claims, 4 Drawing Sheets

MOLD AND METHOD FOR MAKING VARIABLE HARDNESS CASTINGS

BACKGROUND OF THE INVENTION

1. Field of the Invention

This invention relates to a mold and method for making a metal casting having variable hardness properties throughout the casting and, more particularly, to a mold having thermally conductive members selectively received therein wherein the conductive members create differing cooling conditions for the molded article and are easily inserted and removed from the mold. In another aspect, the invention relates to a method for making a molded article wherein the hardness of the molded article differs throughout the product.

2. Description of the Related Art

In industrial molding processes, it is known to cast metal parts in a sand or resin mold and selectively develop different metallurgical properties throughout portions of the molded article through the use of chill inserts provided in the sand or resin mold. In this process, a conventional mold is prepared and a recess is formed therein for the receipt of a small metal insert positioned in the mold such that it will contact the molten metal entering the mold cavity. As the molten metal is received in the mold cavity, the chill insert cools the molded article more quickly than the remainder of the molded article and hardens the area of the molded article immediately adjacent to the chill. The molded article and chill are removed from the mold by a "shakeout" process which requires breaking apart the mold. The chill inserts are recovered by hand sifting through the waste sand of the used mold. After the chills are recovered, they must be inspected for damage and then sorted according to size and application.

This process for molding a selectively hardened molded article is extremely labor intensive and inefficient with respect to the recovery and reuse of the chill inserts.

Other known mold assemblies for selectively hardening a molded article are seen in U.S. Pat. No. 5,072,773 issued Dec. 17, 1991 to Ruff, et al.; U.S. Pat. No. 843,679 issued Feb. 12, 1907 to Johns; Japanese Patent Document No. 59-184697 to Kuwabara dated Apr. 1, 1986; Japanese Patent Document No. JP-058741 to Shinden dated Dec. 5, 1981; Japanese Patent Document No. 60-151884 to Mai dated Jan. 22, 1987; Japanese Patent Document No. 62-217639 to Kanemitsu dated Mar. 8, 1989; and Japanese Patent Document No. 57-148258 to Kinoshita dated Mar. 3, 1984.

Each of the known molds and methods for creating a selectively hardened molded article are inefficient and require significant investments in either labor or capital equipment thereby dramatically increasing the cost for the molded article.

SUMMARY OF THE INVENTION

The mold and method for making a molded article according to the invention overcome the problems of the prior art by creating a mold assembly in which chill members are quickly and easily inserted and removed therefrom without significant investments in labor or capital equipment.

In one aspect, the invention comprises a mold assembly for producing a molded article. The mold assembly comprises a cope and drag, each of which have an exterior surface and a mold joint surface. The mold joint surfaces of the cope and drag abut one another and define a mold cavity therebetween. At least one chill aperture is formed in either the cope, the drag, or both. The aperture extends from the exterior surface to a point adjacent to at least a portion of the mold cavity. A chill member support plate is provided and at least one chill member depends from the chill member support plate. The chill member is slidably receivable into the chill aperture such that the molding edge of the chill member is positioned adjacent the mold cavity. The chill member is also slidably removable from the at least one chill aperture prior to shake-out of the molded article from the mold cavity.

Preferably, chill members are provided for both the cope and drag and the sidewalls and front and rear walls of the chill members are tapered such that the chill members are easily slidably receivable into the cope and drag.

In another aspect, the invention relates to a method for producing a molded article. The method comprises the steps of providing a mold having an exterior surface, a molding surface, a mold cavity formed in at least a portion of the molding surface and a chill aperture extending from the exterior surface to the molding surface. A chill member is provided on a chill support plate such that an exterior surface of the chill member is adjacent the support plate and a molding surface of the chill member is spaced therefrom. The chill member is selectively mounted in the chill aperture of a mold prior to pouring the molten material into the mold. Next, molten molding material is poured into the mold cavity to create a molded article. The molded article is differentially cooled inside the mold as a result of the different thermal conductivity of the chill member and the mold. Next, the chill member is removed from the chill aperture following solidification. Finally, the molded article is removed from the mold after the chill member has been removed therefrom.

Preferably, the chill member is slidably received into and slidably removed from the mold.

Also encompassed within the scope of the method according to the invention is the steps of forming the mold prior to selectively receiving the chill member. The mold is formed by providing a chill print on a chill print support plate wherein the chill print has an exterior edge depending from the chill print support plate and a molding edge spaced therefrom. A forming mold is provided which has a molding recess formed therein. At least a portion of a pattern for a molded article is positioned in the molding recess. Next, the chill print is inserted into the molding recess of the forming mold. Mold material is provided to the molding recess to form the mold. Finally, the chill print, pattern and forming mold are removed from the mold, resulting in a mold adapted to receive the chill members described above.

BRIEF DESCRIPTION OF THE DRAWINGS

The invention will now be described with reference to the drawings in which.

DETAILED DESCRIPTION OF THE PREFERRED EMBODIMENTS

Figure 1:
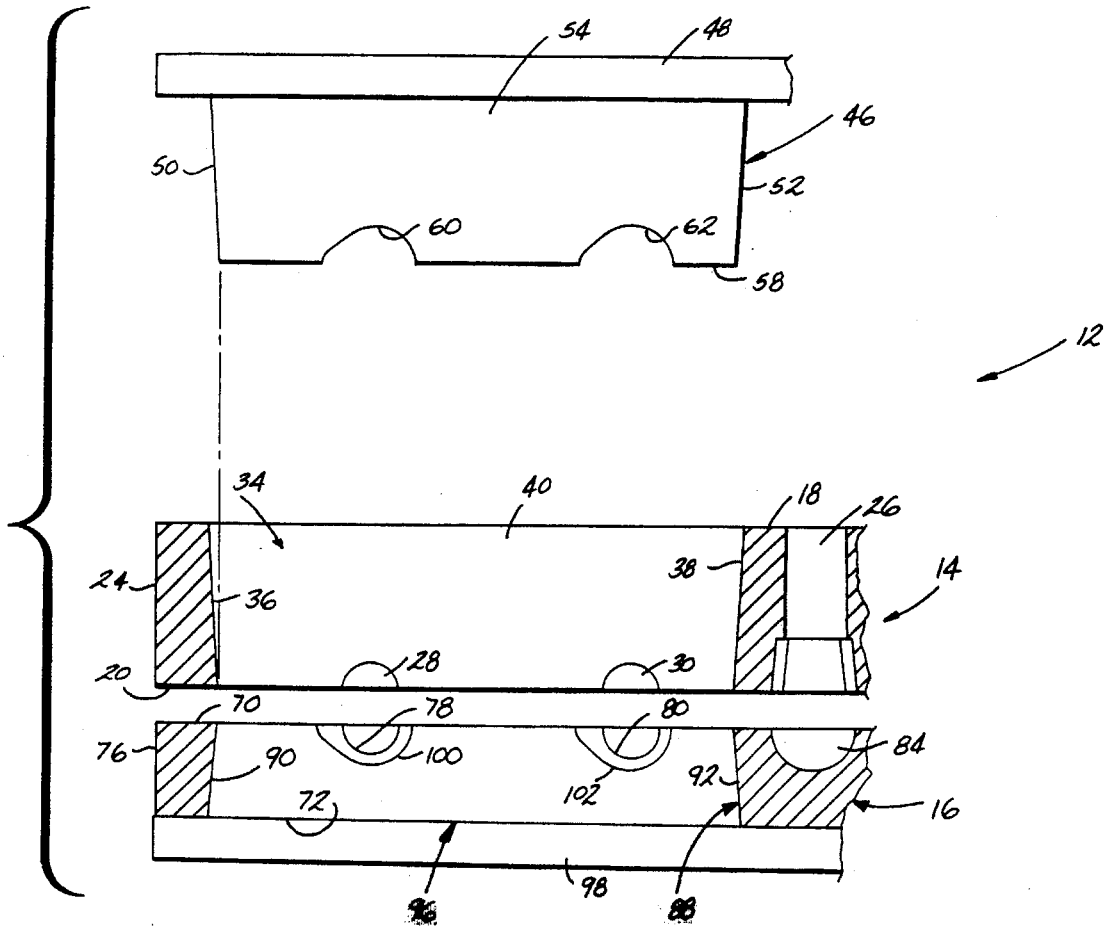
FIG. 1 is a partial sectional, exploded end view of a mold assembly according to the invention.

Turning now to the drawings and to FIG. 1 in particular, a mold assembly 12 according to the invention is shown. The mold assembly 12 depicted in FIGS. 1–9 and described below is utilized for forming automotive camshafts. However, it is understood that the mold assembly according to the invention can be utilized with any molded article in which differential metallurgical properties are desired within the product and these varying properties are obtained by differing cooling rates for the molded article.

The mold assembly 12 comprises a cope 14 and a drag 16, both of which are formed from a conventional sand or resin molding material. The cope 14 has a top surface 18, a bottom surface 20, a front wall 22 (FIG. 7), a rear wall (not shown), and a pair of opposed side walls 24. A pouring cup conduit 26 is formed in the center of the cope 14 and a plurality of mold cavities 28, 30, 32 are also formed therein. A conventional shrinkage bob 42 is provided in the cope 14 to supply molten metal to the mold cavity during the cooling process to compensate for shrinkage during solidification. A plurality of chill apertures 34 are formed in the cope 14 and comprise a pair of tapered side walls 36, 38, a rear wall 40 and a front wall (not shown).

The chill aperture 34 is adapted to receive a chill member 46 which depends from a chill carrier plate 48. The chill member 46 comprises a pair of tapered side walls 50, 52, a front wall 54, a rear wall 56, and a bottom wall 58. A pair of mold half cavity recesses 60 are formed in the bottom wall 58 of the chill member 46. Preferably, the chill member 46 and chill carrier plate 48 are formed of a thermally conductive material which is resistant to high heat and is durable. Examples of suitable materials include aluminum alloys and steel.

The chill member 46 is preferably snugly received inside the chill aperture 34 to prevent movement of the chill member 46 within the cope 14 during processing. The mold half cavity recesses 60, 62 of the chill member 46 are aligned with the mold half cavities 28, 30 of the cope such that molten metal inside the molten cavity will contact at least a portion of the chill member 46. Preferably, multiple chill members 46 depend from a single chill carrier plate 48 and the chill members are secured to the plate by a conventional fastening method such as welding or mechanical fasteners such as bolts.

FIG. 1 shows the chill member 46 removed from the cope 14 and the chill member of the drag received therein. The drag 16 is similar in structure to the cope 14 and comprises a top surface 70, a bottom surface 72, a front wall 74, a rear wall (not shown) and a pair of opposed side walls 76. A plurality of mold half cavities 78, 80, 82 are formed in the drag 16 along with a runner 84 and gates 86 for conveying the molten metal from the pouring cup conduit 26 to the mold cavities.

At least one chill aperture 88 is formed in the drag 16 and is defined by a pair of tapered side walls 90, 92, a rear wall 94 and a front wall 95. Similar to the cope, the drag chill aperture 88 selectively receives chill members 96 supported by a chill carrier plate 98. The chill member 96 has a plurality of mold half cavity recesses 100, 102 formed therein.

The mold assembly 12 according to the invention is ideally suited for mass production of molded articles having variable hardness characteristics on the surface thereof. For example, the mold assembly 12 is ideally suited for mass production of automotive camshafts wherein the lobes of the camshaft are hardened compared to the remainder of the molded article by positioning chill members adjacent the lobes in the mold cavity. During the molding operation, the molten metal flows through the runner 84 and gates 86 into the mold cavities defined by the cope 14, drag 16 and chill members 46, 96 received therein. The molten metal which comes into contact with the chill members 46, 96 is quenched or cools at a significantly faster rate than the molten metal which is in contact with the sand of the cope 14 and drag 16. The chill members 46, 96 conduct heat away from the molded article to obtain a different metallurgical microstructure than the remainder of the molded article.

The challenge of this molding process is to develop a mold structure and method which permits the economical mass production of the selectively hardened molded articles. The mold and method of molding an article according to the invention overcomes this challenge resulting in a more efficient molding method than previously known.

The first step in the method for molding an article according to the invention is to form the cope 14 and drag 16 such that they are adapted to receive the chill members 46, 96. As seen in FIGS. 3–6, the cope 14 and drag 16 are formed in a cope pattern mold 108 and a drag pattern mold 110, respectively. The cope pattern mold 108 comprises a base 112, a front wall 114, a rear wall (not shown), and a pair of opposed side walls 116. The camshaft positive pattern 118 is formed on the base 112 inside the interior surface defined by the front, rear and side walls of the mold 108. The pattern 118 has a plurality of lobe position projections 119 formed thereon which correspond to the location of the lobe along the length of the camshaft. A chill print carrier plate 120 having a plurality of chill prints 122 is received on the top surface of the several walls such that the chill prints 122 extend into the hollow interior of the mold 108 and contact or are held closely adjacent to the lobe position projections 119 of the camshaft pattern 118.

The chill prints 122 are identical in configuration to the chill members 46 except that, in the preferred embodiment, the mold half cavities 124, 126, 128 of the chill prints 122 are circular rather than lobe-shaped corresponding to the circular lobe position projections 119. With this structure, a chill print of a single design can be used for any of the lobes along the length of the camshaft.

With the chill prints 122 and chill print carrier plate 120 in position, a suitable sand or resin material is injected into the hollow interior defined by the carrier plate 120 and walls of the mold 108. The mold material is injected through suitable apertures 130 formed in the chill print carrier plate 120 and fills the entire hollow interior thereby creating the cope 14 of the mold assembly 12. While only a single aperture 130 is shown in the figures, any number of apertures can be incorporated to provide molding material to all reaches of the hollow interior.

After the mold material has sufficiently hardened, the chill prints 122 are removed from the molded cope 14 by lifting the carrier plate 120 with respect to the cope 14. Next, the cope 14 is removed from the cope pattern mold 108. It should be noted that the cope and drag produced according to the process do not require use of a flask during molding of the camshaft. In fact, the flask has been expressly eliminated to reduce costs and improve efficiency.

Figure 4:
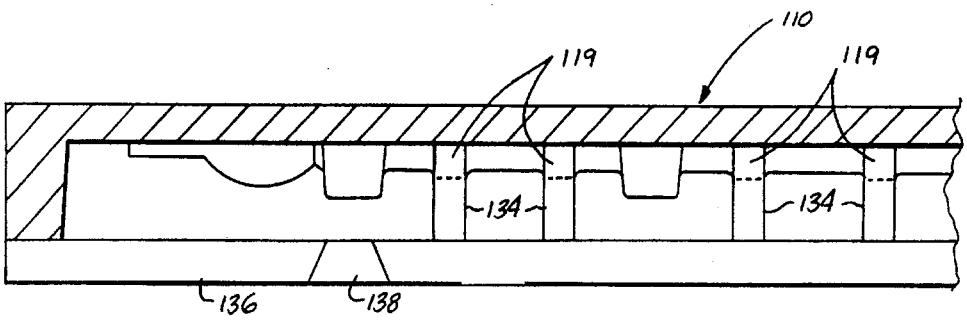
FIG. 4 is a partial sectional side elevational view of the drag forming mold.
Figure 6:
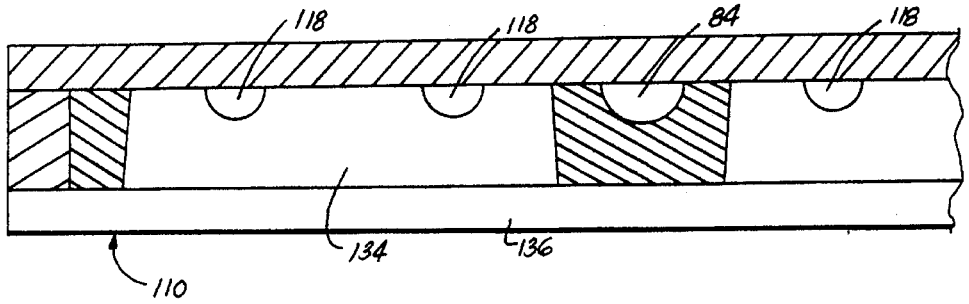
FIG. 6 is a partial sectional, end elevational view of the drag forming mold.
Figure 2:
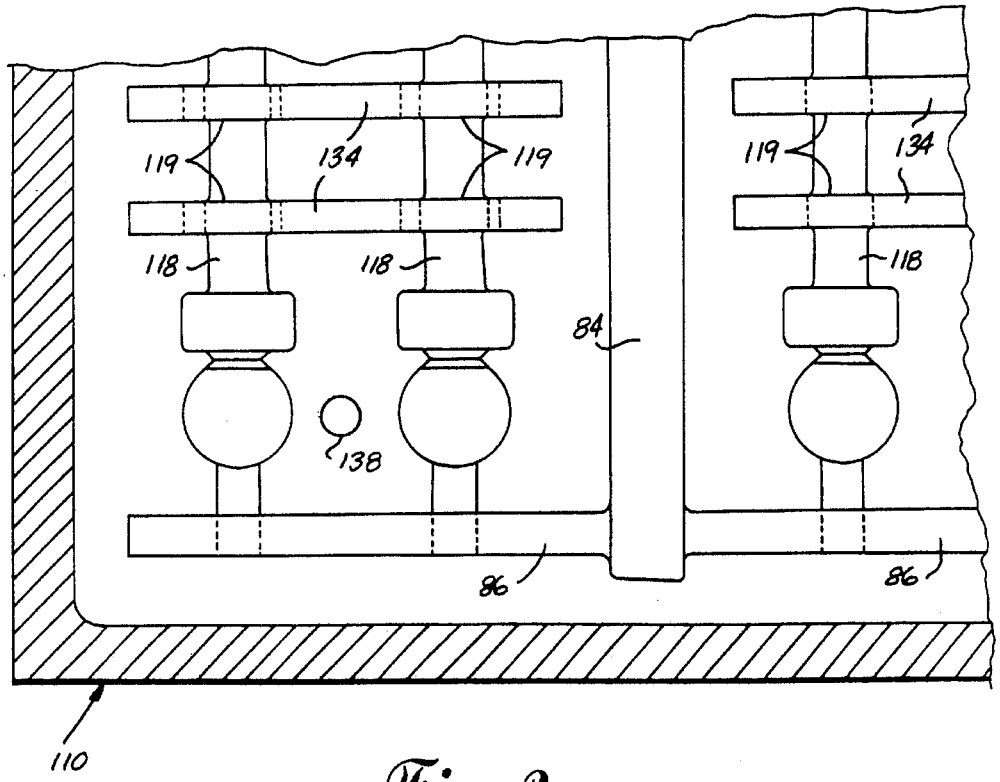
FIG. 2 is a top view of the drag pattern mold showing the camshaft pattern.

FIGS. 4 and 6 show the structure for forming the drag from the drag pattern mold 110. The drag 16 is formed by the same process as the cope 14 described above. Namely, chill prints 134 depending from a chill print carrier plate 136 are received in the hollow interior of the drag pattern mold 110 and a suitable molding material is injected into the hollow interior through mold material injection apertures 138. The chill prints 134 are removed from the molded drag 116 which is in turn removed from the drag pattern mold 110.

Figure 8:
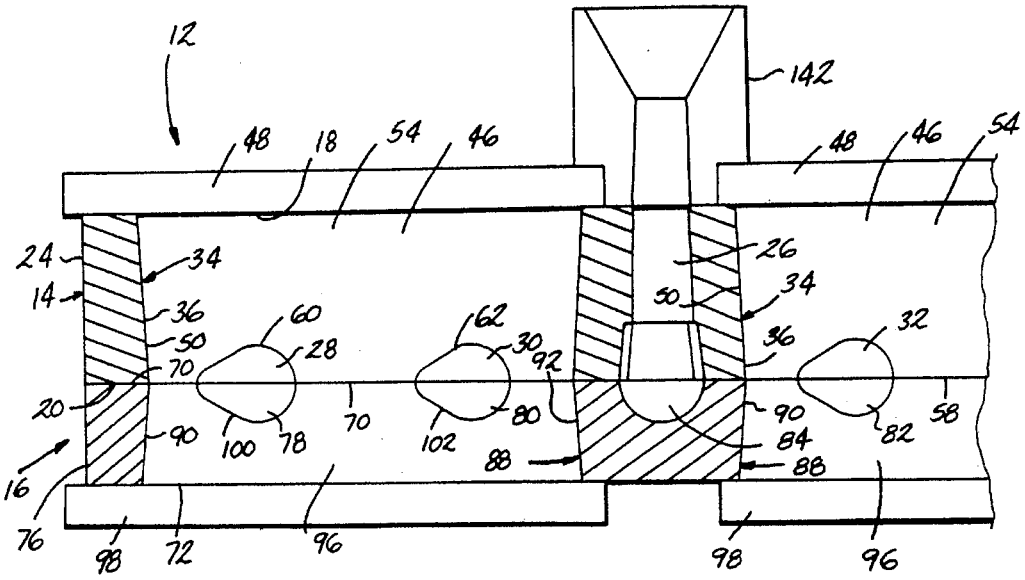
FIG. 8 is a partial sectional, end elevational view of the mold assembly according to the invention.
Figure 5:
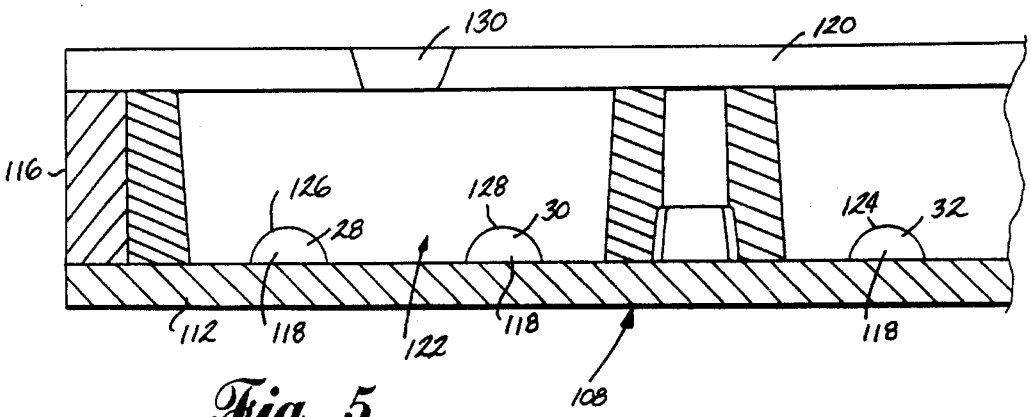
FIG. 5 is a partial sectional, end elevational view of the cope forming mold.

After the cope 14 and drag 16 have been formed from the molding material, the mold assembly 12 is prepared. First, the cope chill members 46 are positioned in the cope chill apertures 34 and the drag chill members 96 are positioned in the drag chill apertures 88. Next, the cope 14 is positioned on the drag 16 such that the molding cavities of the cope 14 and drag 16 are aligned to create a negative mold for the camshaft. As seen in FIG. 8, the opposed chill members 46, 96 are contoured to define a mold cavity for a lobe of the camshaft.

Molten metal is poured into the pouring cup 142 and flows down the pouring conduit 26 into the runner 84, to the gates 86 and ultimately to the mold cavity. As the molten metal contacts the molding material of the cope 14 and drag 16, the molten metal will cool at a first, prescribed rate. When the molten metal contacts the chill members 46, 96, it will be cooled at a second rate different from the first. For formation of a camshaft having hardened lobes, the chill members 46, 96 preferably cool the molten metal at a rate faster than the mold material. The heat of the lobes of the camshaft will be conducted through the chill members 46, 96 to the chill carrier plates 48, 98 and ultimately to the environment.

Figure 9:
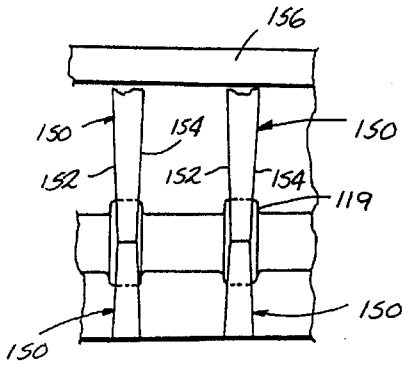
FIG. 9 is a side elevational view of an alternative embodiment of the chill members according to the invention.
Figure 7:
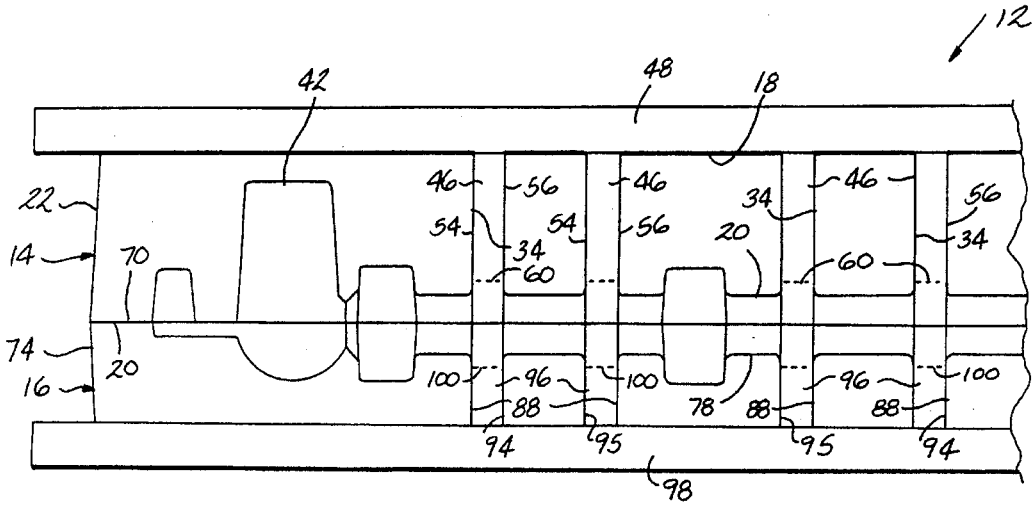
FIG. 7 is a partial sectional, side elevational view of the mold assembly according to the invention.
Figure 3:
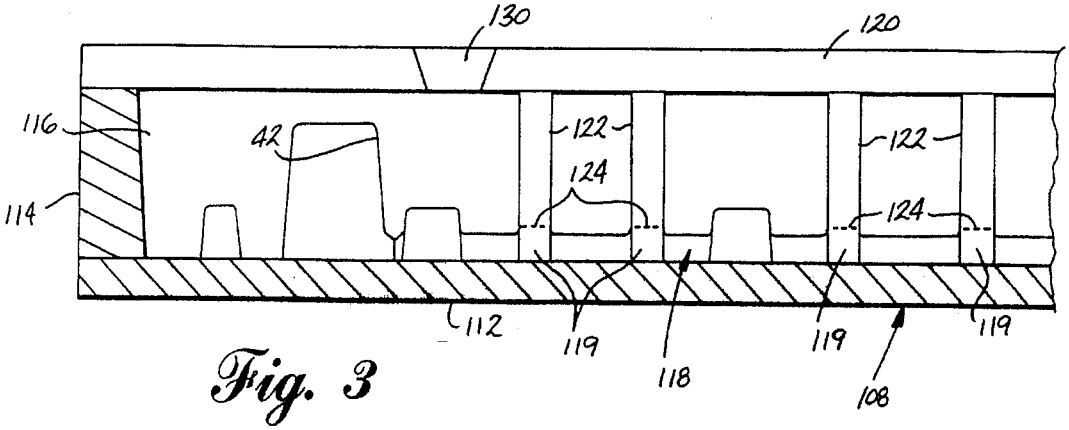
FIG. 3 is a partial sectional side elevational view of the cope forming mold.

FIG. 9 is a side elevational view of an alternative embodiment of the chill members according to the invention. In this embodiment, the chill members 150 are tapered such that the spacing between the front wall 152 and rear wall 154 varies along the length of the chill member 150 such that the portion of the chill member 150 immediately adjacent the lobe position projection 119 is narrower than the adjacent chill carrier plate 156. This structure is ideally suited to produce a cam shaft with lobes having rounded side edges. In addition, the tapered chill member 150 provides a greater mass for conducting heat away from the lobe than a chill member having parallel sides. While FIG. 9 only fully depicts the cope chill members 150, the drag chill members 160 are preferably identical thereto.

While the mold assembly according to the invention is preferably used to cool a portion of the molded article at a faster rate than the remainder of the mold, it is within the scope of the invention that the temperature of the chill members can be controlled up or down to create a differing microstructure in the molded article. For example, the thermally conductive chill members can be heated, cooled, or both, during solidification and cooling of the molded article by applying a source of heat or heat sink to the thermally conductive chill carrier plates. This structure provides greater flexibility in selectively controlling the microstructure of the molded article.

The mold structure and method for molding an article according to the invention provides several distinct advantages over the prior art. First, the need for flasks surrounding the cope and drag have been eliminated. This reduces the overall cost of the capital equipment needed to produce the molded article. For a mass production system, elimination of these elements results in significant savings in capital equipment and improved efficiency.

Perhaps the greatest advantage of the invention over the prior art is the labor and material savings in the structure of the chill members. Rather than using individual, discrete chills inserted into a mold by hand and then manually retrieved from a pile of scrap molding sand, multiple chills have been mounted to a single plate which can be easily inserted immediately prior to molding and removed from the mold prior to shake-out of the molded article. Therefore, the chill members will not be subjected to the damage and wear and tear involved in the shake-out process. This will result in significant labor savings over the prior art.

Still another advantage over the prior art is the reduction of the number of chill members for a system of mass production. The chills according to the invention are removed from the cope and drag prior to shake-out and immediately transferred back to a stage in the process for insertion into the next appropriate mold. In the prior art, the inserts are shaken out with the scrap mold material during shake-out and remain there until the sand has cooled sufficiently such that workers can hand pick through the sand to retrieve the inserts. This is an extremely labor-intensive and time-consuming process compared to the method of the invention.

Yet another advantage achieved over the prior art is increased quality control in the system. By using fewer numbers of chills, better quality control can be maintained for the resulting product. Moreover, the particular chill print and carrier plate used to manufacture a particular camshaft can be tracked through the use of automation, so that the chill member can be modified to correct any defects or necessary repairs.

Reasonable variation and modification are possible within the spirit of the foregoing specification and drawings without departing from the scope of the invention.

The embodiments for which an exclusive property or privilege is claimed are defined as follows:

1. A mold assembly for producing a molded article comprising:

a cope having an exterior surface and a mold joint surface;

a drag having an exterior surface and a mold joint surface;

a mold cavity defined by at least a portion of the mold joint surfaces of the cope and drag when said mold joint surfaces abut one another;

at least one chill aperture formed in one of the cope and drag, the at least one aperture extending from the exterior surface to a point adjacent to at least a portion of the mold cavity and being defined by at least one tapered sidewall so that the aperture adjacent the exterior surface is greater than that adjacent the mold cavity;

a chill member support plate; and at least one chill member depending from the chill member support plate and having a molding edge and at least one tapered sidewall extending from the molding edge toward the support plate, the at least one tapered sidewall of the at least one chill member cooperating with the at least one tapered sidewall of the at least one chill aperture so that the at least one chill member is slidably receivable into the at least one chill aperture so that the molding edge is positioned adjacent the mold cavity and slidably removable from the at least one chill aperture prior to shakeout of the molded article from the mold cavity.

2. A mold assembly according to claim 1 wherein the chill member support plate abuts the exterior surface of said one of the cope and drag when the at least one chill member is fully received in the at least one chill aperture.

3. A mold assembly according to claim 1 wherein the at least one chill member further comprises a front wall and an opposed rear wall, the front and rear walls being tapered so that the chill member is narrower adjacent the molding edge than adjacent the exterior edge to permit slidable movement of the at least one chill member into and out of the at least one chill member aperture.

4. A mold assembly according to claim 3 wherein the at least one chill aperture further comprises a front wall and an opposed rear wall, the front and rear walls being tapered complementary to the tapered sidewalls of the at least one chill member.

5. A mold assembly according to claim 1 wherein the mold cavity is defined, in part, by at least a portion of the molding edge of the at least one chill member.

6. A mold assembly according to claim 1 wherein the at least one chill member aperture is formed in the cope.

7. A mold assembly according to claim 6 and further comprising:

at least one chill member aperture formed in the drag, the at least one drag aperture extending from the exterior surface to a point adjacent to at least a portion of the mold cavity;

a drag chill member support plate;

at least one drag chill member provided on the drag chill member support plate, the at least one drag chill member having an exterior edge and a molding edge, the at least one drag chill member being slidably receivable into the at least one drag chill aperture so that the molding edge is positioned adjacent the mold cavity and slidably removable from the at least one drag chill aperture prior to shakeout of the molded article from the mold cavity.

8. A mold assembly according to claim 7 wherein the at least one drag chill member further comprises a pair of opposed walls, the walls being tapered so that drag chill member is narrower adjacent the molding edge than the exterior edge to permit slidable movement of the at least one drag chill member into and out of the at least one drag chill member aperture.

9. A mold assembly according to claim 8 wherein the at least one drag chill aperture further comprises a pair of opposed walls, the walls being tapered complementary to the tapered walls of the at least one drag chill member.

10. A mold assembly according to claim 1 wherein the at least one chill member aperture is formed in the drag.

11. A mold assembly according to claim 9 and further comprising:

at least one chill member aperture formed in the cope the at least one cope aperture extending from the exterior surface to a point adjacent to at least a portion of the mold cavity;

a cope chill member support plate;

at least one cope chill member provided on the cope chill member support plate, the at least one cope chill member having an exterior edge and a molding edge, the at least one cope chill member being slidably receivable into the at least one cope chill aperture so that the molding edge is positioned adjacent the mold cavity and slidably removable from the at least one cope chill aperture prior to shakeout of the molded article from the mold cavity.

12. A mold assembly according to claim 11 wherein the mold cavity is defined, in part, by at least a portion of the molding edge of the at least one cope chill member.

13. A method of producing a molded article comprising the steps of:

providing a mold having an exterior surface, a molding surface, a mold cavity formed at least in part by the molding surface and a chill aperture extending from the exterior surface to the molding surface;

providing a chill support plate;

providing a chill member having an exterior surface and a molding surface, the chill member depending from the chill support plate so that the exterior surface is adjacent the support plate and the molding surface is spaced therefrom;

slidably mounting the chill member in the chill aperture prior to molding the molded article;

providing a molten molding material to the mold cavity to create a molded article;

differentially cooling the molded article as a result of different thermal conductivity of the chill member and the mold;

slidably removing the chill member from the chill aperture after solidification of the molten molding material; and removing the molded article from the mold after the chill member has been removed therefrom;

whereby a molded article having variable hardness throughout the article is created as a result of the differential cooling of the molded article.

14. A method of forming a molded article according to claim 13 wherein the chill member has at least one tapered sidewall extending from the molding surface toward the exterior surface and the chill aperture has at least one tapered sidewall complementary to the at least one sidewall of the chill member, said tapered sidewalls cooperating to accommodate sliding movement of the chill member into and out of the aperture.

15. A method of producing a molded article according to claim 13 comprising the step of forming the mold prior to selectively receiving the chill member by:

providing a chill print support plate;

providing a chill print having an exterior edge and a molding edge, the exterior edge depending from the chill print support plate and the molding edge being spaced therefrom;

providing a forming mold having a molding recess provided therein;

providing at least a portion of a pattern for a molded article in the molding recess of the forming mold inserting the chill print into the molding recess of the forming mold;

providing a mold material to the molding recess;

forming the mold having a chill member aperture defined, at least in part, by the contour of the chill print and a mold cavity defined, at least in part, by the contour of the pattern for the molded article;

slideably removing the chill print from the mold;

removing the pattern for the molded article from the mold;

removing the mold from the forming mold.

16. A method of forming a molded article according to claim 15 wherein the chill print has at least one tapered sidewall extending from the molding surface toward the exterior surface, the at least one tapered sidewall of the chill print being complementary to the at least one sidewall of the chill aperture, said tapered sidewalls cooperating to accommodate sliding movement of the chill print out of the aperture.

17. A method of forming a molded article according to claim 15 wherein the chill print comprises a cope chill print, the chill print support plate comprises a cope chill print support plate, the forming mold comprises a cope forming mold, the mold comprises a cope, the chill support plate comprises a cope chill support plate, the chill member comprises a cope chill member, and the chill aperture comprises a cope chill aperture.

18. A method of forming a molded article according to claim 17 and further comprising the steps of:

providing a drag having an exterior surface, a molding surface, a mold cavity formed at least in part in the molding surface and a drag chill aperture extending from the exterior surface to the molding surface;

providing a drag chill support plate;

providing a drag chill member having an exterior surface and a molding surface, the drag chill member depending from the chill support plate such that the exterior surface is adjacent the drag chill support plate and the molding surface is spaced therefrom;

selectively mounting the drag chill member in the drag chill aperture prior to molding the molded article;

slideably removing the drag chill member from the drag chill aperture after solidification of the molten molding material; and removing the molded article from the drag after the chill member has been removed therefrom;

whereby a molded article having variable hardness throughout the article is created as a result of the differential cooling of the molded article.

19. A method of forming a molded article according to claim 18 and further comprising the step of forming the drag prior to selectively receiving the drag chill member by:

providing a drag chill print support plate;

providing a drag chill print having an exterior edge and a molding edge, the exterior edge depending from the drag chill print support plate and the molding edge being spaced therefrom;

providing a drag forming mold having a molding recess provided therein;

providing at least a portion of a pattern for a molded article in the molding recess of the drag forming mold inserting the drag chill print into the molding recess of the drag forming mold;

providing a mold material to the molding recess;

forming the drag having a drag chill member aperture defined, at least in part, by the drag chill print and a mold cavity defined, at least in part, by the pattern for the molded article;

slideably removing the drag chill print from the drag;

removing the pattern for the molded article from the drag; and removing the drag from the drag forming mold.

20. A mold assembly for the casting of a molded article comprising:

a flaskless cope having an exterior surface and a mold joint surface;

a flaskless drag having an exterior surface and a mold joint surface, the mold joint surfaces of the cope and drag abutting one another;

a mold cavity defined by at least a portion of the mold joint surfaces of the cope and drag;

a cope chill aperture formed in the cope, the aperture extending from the exterior surface to the mold cavity and comprising a plurality of tapered sidewalls so that a width of the aperture adjacent the exterior surface is greater than a width of the aperture adjacent the mold cavity;

a cope chill member support plate;

a cope chill member depending from the cope chill member support plate and having a molding edge and a plurality of tapered sidewalls extending from the molding edge toward the support plate, wherein the tapered sidewalls of the chill member cooperate with the tapered sidewalls of the cope chill aperture so that the chill member is slidably receivable into the chill aperture and the molding edge comprises at least a portion of the molding cavity and the cope chill member is slidably removable from the cope chill aperture prior to shakeout of the molded article from the mold cavity;

a drag chill aperture formed in the drag, the aperture extending from the exterior surface to the mold cavity and comprising a plurality of tapered sidewalls so that a width of the aperture adjacent the exterior surface is greater than a width of the aperture adjacent the mold cavity;

a drag chill member support plate;

a drag chill member depending from the drag chill member support plate an having a molding edge and a plurality of tapered sidewalls extending from the molding toward the support plate, wherein the tapered sidewalls of the drag chill member cooperate with the tapered sidewalls of the drag chill aperture so that the drag chill member is slidably receivable into the drag chill aperture and the molding edge comprises at least a portion of the molding cavity and the drag chill member is slidably removable from the drag chill aperture prior to shakeout of the molded article from the mold cavity.

* * * * *

UNITED STATES PATENT AND TRADEMARK OFFICE

CERTIFICATE OF CORRECTION

PATENT NO. : 5,533,563

DATED : July 9, 1996

INVENTOR(S) : Lee, Sr.

It is certified that error appears in the above-indentified patent and that said Letters Patent is hereby corrected as shown below:

Claim 11, column 7, line 54, "claim 9" should read --claim 10--.

Signed and Sealed this

Twenty-second Day of October, 1996

Bruce Lehman

*Attest:*

BRUCE LEHMAN

*Attesting Officer*

*Commissioner of Patents and Trademarks*